US008043439B2

(12) United States Patent
Park

(10) Patent No.: US 8,043,439 B2
(45) Date of Patent: Oct. 25, 2011

(54) METHOD FOR CONTROLLING DISH WASHER

(75) Inventor: Nung Seo Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 418 days.

(21) Appl. No.: 12/254,986

(22) Filed: Oct. 21, 2008

(65) Prior Publication Data

US 2009/0126763 A1 May 21, 2009

(30) Foreign Application Priority Data

Oct. 22, 2007 (KR) ..... 10-2007-0106225

(51) Int. Cl.
*B08B 9/20* (2006.01)

(52) U.S. Cl. ..... 134/25.2; 134/18; 134/26

(58) Field of Classification Search ..... None
See application file for complete search history.

(56) References Cited

U.S. PATENT DOCUMENTS 3,888,269 A * 6/1975 Bashark ..... 134/57 D

FOREIGN PATENT DOCUMENTS

| | | |
|---|---|---|
| JP | 10-323318 | 12/1998 |
| JP | 2000-083886 | 3/2000 |
| KR | 10-2003-0065203 A | 8/2003 |
| KR | 10-2003-0092203 A | 12/2003 |
| KR | 10-2007-0068189 A | 6/2007 |

OTHER PUBLICATIONS

Korean Office Action dated Apr. 26, 2010 for Application No. 10-2007-0106225.
Korean Office Action dated May 19, 2009.
Korean Notice of Allowance dated Oct. 15, 2010 issued in Application No. 10-2007-0106225.

* cited by examiner

*Primary Examiner* — Michael Kornakov
*Assistant Examiner* — Ryan Coleman
(74) *Attorney, Agent, or Firm* — KED & Associates LLP

(57) ABSTRACT

A dishwasher and a method for controlling the same are provided. The dishwasher includes a contamination level sensor that measures a contamination level of washing water in a washing tub of the dishwasher. The method includes supplying washing water to an inside of the dishwasher, washing dishes by spraying the washing water to the inside of the dishwasher, temporarily pausing the washing of the dishes for a preset time period, and resuming the washing of the dishes after the preset time period.

12 Claims, 5 Drawing Sheets

METHOD FOR CONTROLLING DISH WASHER

This application claims the benefit of the Patent Korean Application No. 10-2007-0106225, filed on Oct. 22, 2007, which is hereby incorporated by reference as if fully set forth herein.

BACKGROUND OF THE INVENTION

1. Field of the Invention

The present invention relates to a method for controlling a dish washer, and more particularly, to a method for controlling a dish washer, in which a contamination level sensor is made to measure a contamination level of a washing tub, accurately.

2. Discussion of the Related Art

In general, the dish washer is provided with a case which forms an exterior thereof, and a washing tub for holding dishes to be washed. The washing tub is provided with a spray arm for spraying washing water to the dishes, and a sump for supplying and collecting the washing water. The washing tub also provided with a washing pump for pumping the washing water from the sump to the spray arm, and a water supply valve connected to a water supply hose for closing/opening the washing water flowing to/from the washing tub.

The washing tub may also be provided with a drain pump for pumping the washing water collected in the sump after finishing washing to an outside of the dish washer, an air guide for making air in the washing tub to be in communication with air outside of the washing tub during water supply, and a water level sensor for sensing a water level of the washing tub.

Moreover, in order to measure a contamination level of the washing water, a dirt chamber may be provided, which is in communication with the sump, and a contamination level sensor may be provided thereto for measuring the contamination level.

The operation of the dish washing will be described.

If the washing water is supplied to a preset level, a controller applies to close the water supply valve.

At the same time with stopping of the water supply, the washing pump is put into operation, to pump the washing water from the sump to the spray arm, and the spray arm sprays the washing water to the dishes held in the washing tub, thereby carrying out a washing course.

In the meantime, the contamination level sensor at the dirt chamber measures the contamination level of the washing water for carrying out an optimum washing course. However, during the washing course is carried out, since the washing water forms a vortex as the washing water passes the contamination level sensor, scattering of signals from the contamination sensor is large, such that the controller fails to determine an accurate value of the contamination level sensor, causing difficulty in carrying out an optimum washing course.

SUMMARY OF THE INVENTION

Accordingly, the present invention is directed to a method for controlling a dish washer.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for controlling a dish washer includes a water supplying step for supplying washing water to an inside of a dish washer, a washing step for washing dishes by spraying the washing water to the inside of the dish washer, a pausing step for the controller to control the dish washer in the washing step to pause a washing course for a preset time period temporarily, and a re-washing step for carrying out the washing course which is paused again after the pausing step.

The pausing step includes a contamination level measuring step for measuring a contamination level of the washing water.

The controller controls the washing course according to the contamination level measured at the contamination level sensor in the contamination level measuring step.

The controller performs the pausing step by turning off the dish washer.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
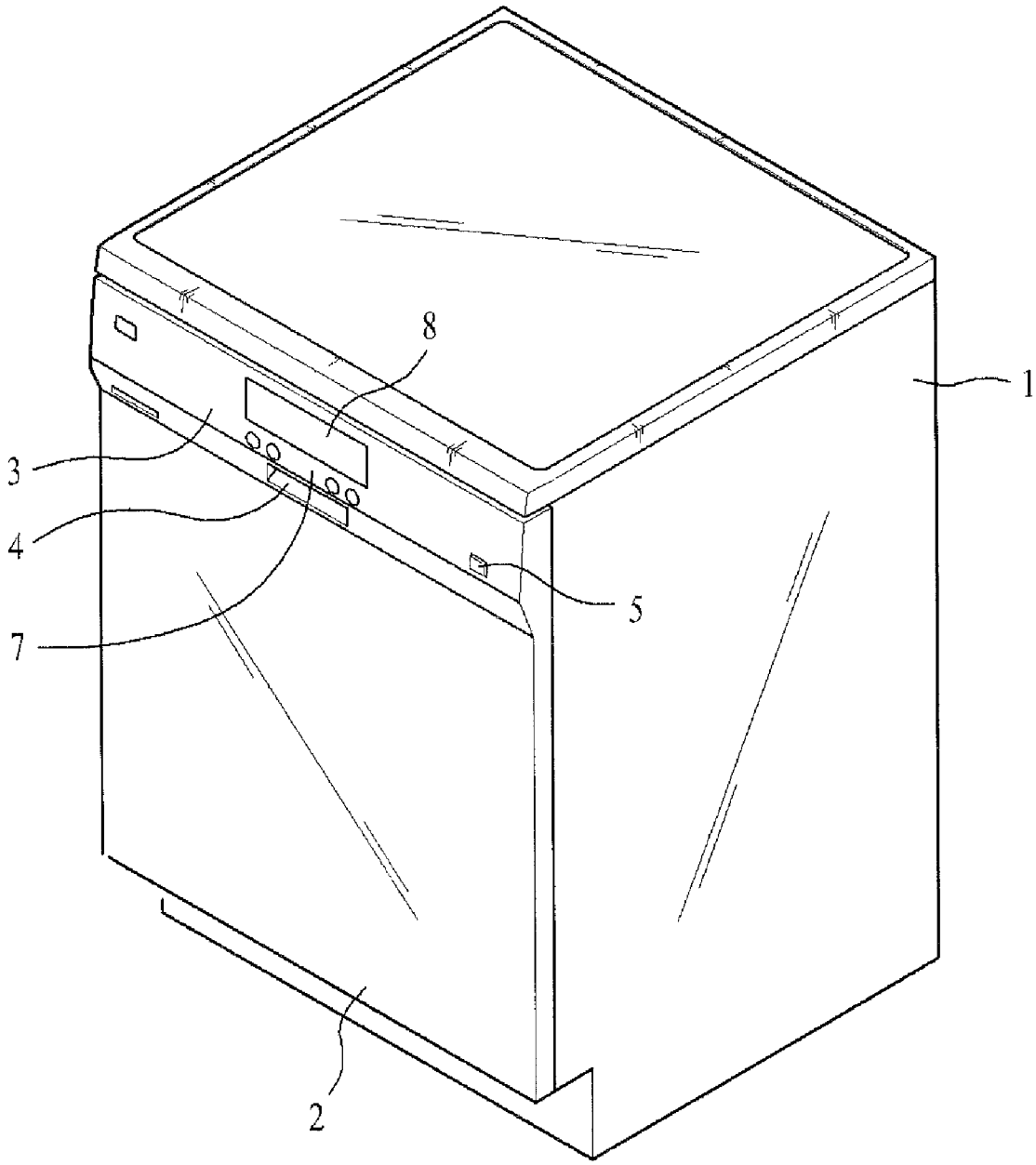
FIG. 1 illustrates a perspective view of a dish washer in accordance with a preferred embodiment of the present invention.
Figure 2:
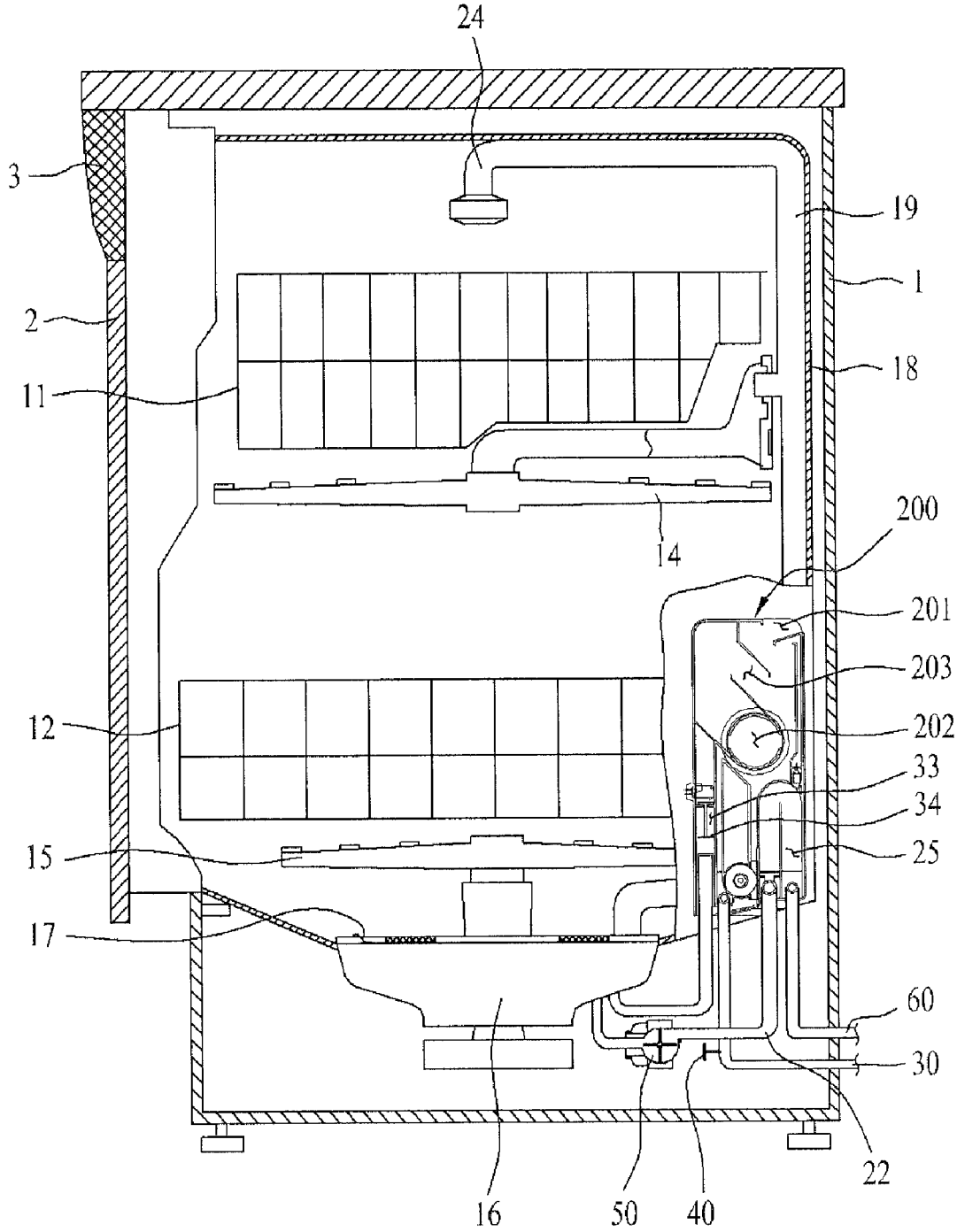
FIG. 2 illustrates a section of the dish washer in FIG. 1.
Figure 3:
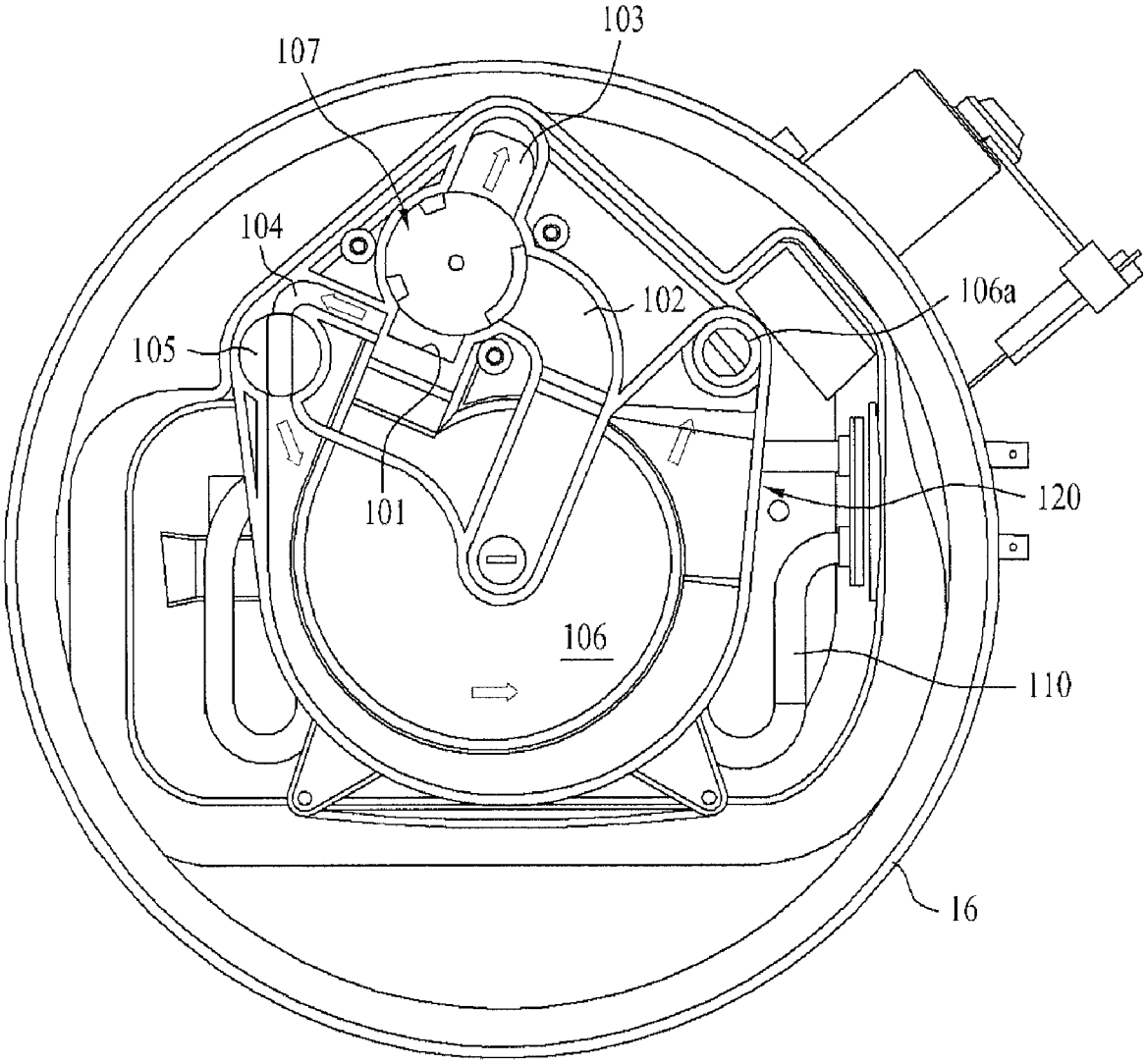
FIG. 3 illustrates a detail of the sump mounted to the dish washer in FIG. 4.
Figure 4:
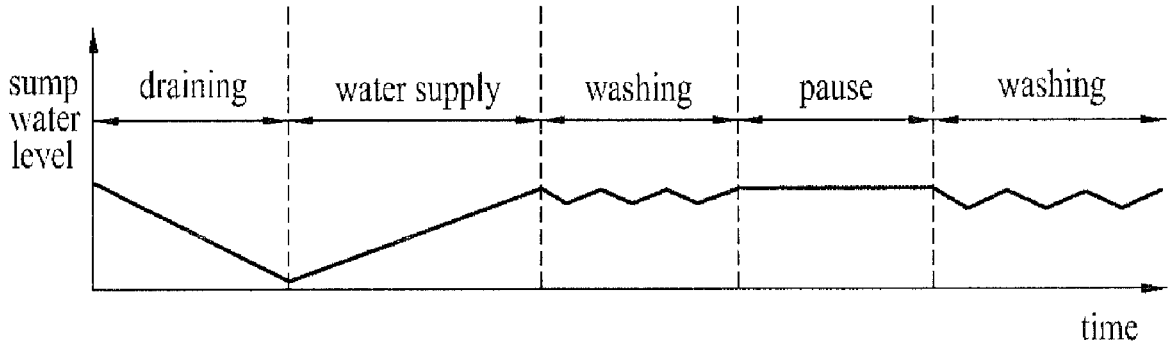
FIG. 4 illustrates a graph showing washing timing of a dish washer versus a water level in a sump.
Figure 5:
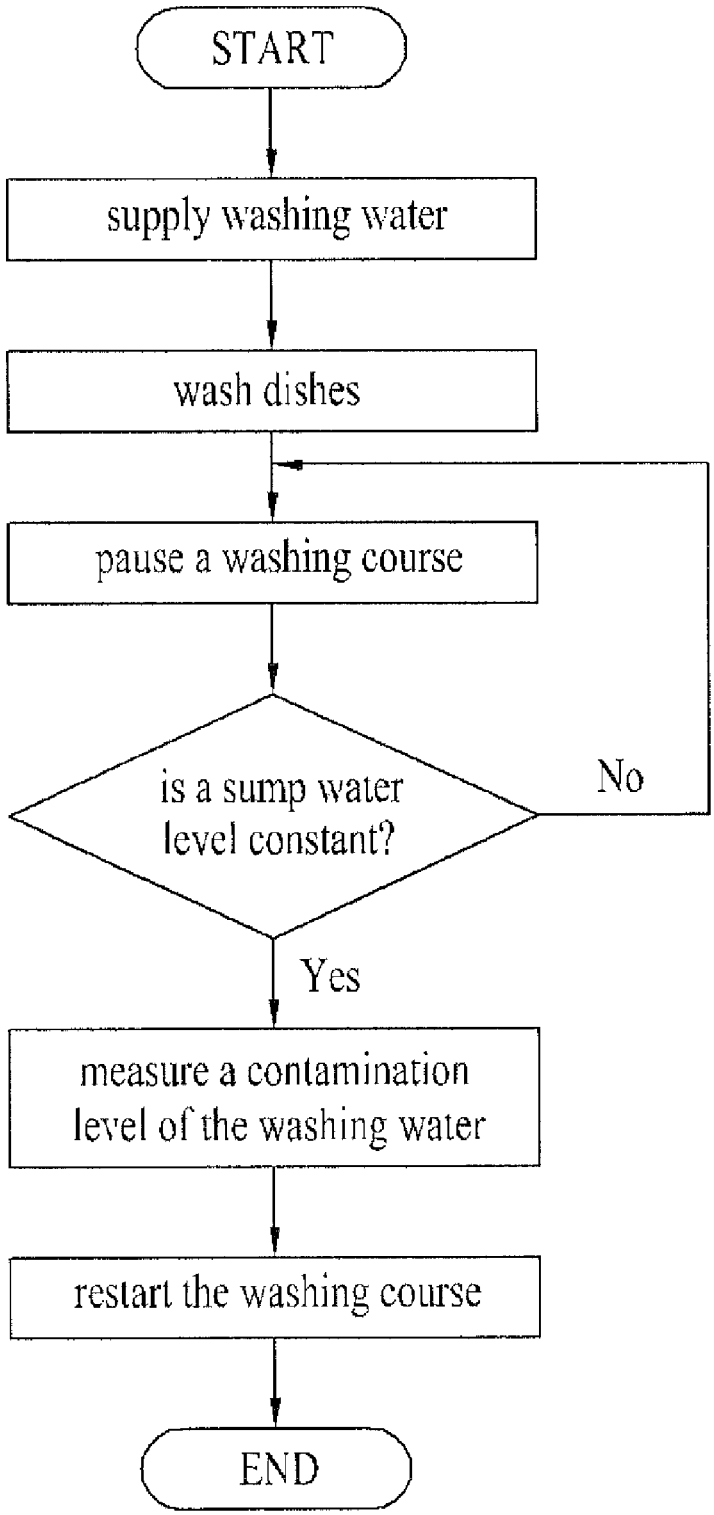
FIG. 5 illustrates the steps of a method for controlling washing of a dish washer in accordance with a preferred embodiment of the present invention.

FIG. 1 illustrates a perspective view of a dish washer in accordance with a preferred embodiment of the present invention, FIG. 2 illustrates a section of the dish washer in FIG. 1, and FIG. 3 illustrates a detail of the sump mounted to the dish washer in FIG. 4. FIG. 4 illustrates a graph showing washing timing of a dish washer versus a water level in a sump, and FIG. 5 illustrates the steps of a method for controlling washing of a dish washer in accordance with a preferred embodiment of the present invention.

Referring to FIGS. 1 and 2, the dish washer includes a case 1 which forms an exterior thereof, a door 2 for closing an opening in the case 1, and a control panel 3 on one side of the case 1 having a controller mounted thereto for displaying and controlling operation of the dish washer.

The control panel 3 has a power switch 5 for turning on/off power to the dish washer, a door handle 4 for handling the door 2, a function control unit 7 for a user to select operation of the dish washer, and a display unit 8 for displaying an operation state of the dish washer.

The dish washer includes a washing tub 18 in the case 1 for providing a space for washing the dishes, and a sump 16 under the washing tub 18 for collecting the washing water, and filtering dirt from the water and re-supplying the washing water to the washing tub 18.

The washing tub 18 has a rack mounted therein for holding the dishes. Though the embodiment describes that two racks of an upper rack 11 and a lower rack 12 are provided, shapes and a number of the racks may vary with sizes and capacities of the dish washers.

Mounted in the washing tub 18, there are spray arms 14 and 15 for spraying the washing water to the upper rack 11 and the lower rack 12 respectively, and a spray arm 24 for spraying the washing water from a top to a bottom of the washing tub 18.

Mounted to the sump 16, there are a washing pump (not shown) for pumping the washing water from the sump 16, and a heater 110 for heating the washing water in the sump 16.

The washing tub 18 has a washing water passage 19 formed in one side thereof for supplying the washing water from the sump 16 to the spray arms 14 and 24 with the washing pump.

There are holes 17 under the washing tub 18, i.e., on top of the sump 16. The washing water used for washing to contain dirt falls down the washing tub 18 and is collected at the sump 16 through the holes 17. The washing water collected at the sump 16 is supplied to the spray arms 14, 15, and 24 again by the washing pump.

In the meantime, the dish washer has an air guide 200 mounted between the case 1 and the washing tub i.e., 18, i.e., on an outside surface of the washing tub 18, for making an external air to be in communication with air in the washing tub 18, additionally.

Therefore, since an inside of the washing tub 18 is always at an atmospheric pressure by means of the air guide 200, an inside pressure of the washing tub 18 can be prevented from rising by steam or high temperature air. This is for preventing the user suffering from danger of injury by a high pressure of the inside of the washing tub 18 when the user opens the door 2 by mistake during operation of the dish washer in a state the washing tub 18 has a high pressure.

The air guide 200 has an air inlet 201 for drawing external air, an opening 202 for communication with air in the washing tub 18, and an air passage 203 for making the air inlet 201 and the opening 202 in communication.

In the meantime, the air guide 200 may have a water supply passage 33 and a drain passage 25 formed separate from the air passage 203. That is, the washing water received from an external water supply source, such as a waterworks, through a water supply pipe 30 is supplied to the sump 16 through the water supply passage 33. The washing water is drained from the sump 16 to a drain pipe 60 extended outside of the dish washer through the drain passage 25 in the air guide 200.

In this instance, at a predetermined position of the water supply pipe 30 which connects the water supply passage 33 to the external water supply source has a water supply valve 40 mounted thereon for opening/closing the washing water being supplied to the water supply passage 33. According to this, once the water supply valve 40 is opened, the washing water is supplied from the external water supply source to the sump 16 through the water supply passage 33.

A water level sensing unit 34 may be mounted to the water supply passage 33 for preventing the washing water from being supplied excessively by making an appropriate amount of the washing water supplied to the dish washer, additionally.

A drain pump 50 is mounted to a predetermined position of a connection pipe 22 which connects the drain passage 25 to the sump 16.

A water level sensor (not shown) may be mounted to the sump 16 additionally for sensing a water level of the sump 16 and draining of water therefrom, and providing a signal thereof to the controller, so that the controller controls the water supply valve 40, the washing pump, the drain pump 50, and the heater 110.

The washing water is drained from the sump 16 to an outside of the dish washer through the drain passage 25 by the drain pump 50. As shown, it is preferable that the drain passage 25 has an inverted U shape and is formed to pass a position higher than the water level of the sump 16.

This is because, if the drain passage 25 is positioned lower than the sump 16, the washing water supplied to the sump 16 newly can be drained through the drain passage 25 due to a difference of heights between the drain passage 25 and the sump 16 and a pressure difference coming from the difference of heights even after the drain pump 50 is turned off.

Though the embodiment describes that the washing water is supplied to the sump 16 through the water supply passage 33 from the external water supply source, and the washing water is drained from the sump 16 to an outside of the dish washer through the drain passage 25, a water supply and drain system is not limited to above. That is, the washing water can be supplied from the external water supply source to the sump 16 directly without passing the air guide 200, or the washing water can be drained from the sump 16, directly.

A structure of the sump 16 in the dish washer will be described in detail, with reference to FIG. 3.

The sump 16 has a heater 110 mounted therein for heating the washing water, and a filtering housing 120 is mounted above the heater 110.

The filtering housing 120 has a washing water inlet 101 formed therein for inlet of the washing water pumped by an impeller, and two main passages 102 and 103 branched from the washing water inlet 101 to form two passages for guiding the washing water to the spray arms 14 and 15, respectively. The dirt chamber 106 has a drain hole **106*a*** formed at one side.

The washing water inlet 101 has a sampling passage 104 connected thereto for tapping a portion of the washing water, and the dirt chamber 106 is connected to the sampling passage 104. The sampling passage 104 has a contamination level sensor 105 mounted thereto for measuring a contamination level of the washing water.

The contamination level sensor 105 may be a sensor having a light emitting unit and a light receiving unit for measuring a turbidity of the washing water. However, other types of the contamination level sensor may be used.

In the meantime, the washing water inlet 101 has a valve 107 rotatably mounted thereto with a flow change over motor (not shown) coupled thereto with a shaft. The flow change over motor rotates the valve 107 in one direction. Following rotation of the flow change over motor, the valve 107 opens/closes the main passages 102 and 103, selectively.

The dish washer of the present invention washes the dishes by performing courses of preliminary washing, main washing, rinsing, heated rinsing, and drying in succession or selectively. A drain course is carried out between above courses. The preliminary course of the dish washer will be described.

Upon starting the preliminary course, an impeller in the sump 16 rotates. The impeller pumps the washing water from the sump 16 to the filtering housing 120, and the pumped washing water flows into the washing water inlet 101 in the filtering housing 120.

Thereafter, following rotation of the flow change over motor, the valve 107 opens/closes the main passages 102 and 103 selectively, such that the washing water flows through one of the main passages 102 and 103 which is opened.

Next, flow of a portion of the washing water into the dirt chamber 106 through the sampling passage 104 will be described.

The sampling passage 104 always has a portion of the washing water flowing therethrough regardless of the valve 107 opening any one of the main passages 102 and 103. In this instance, the contamination level sensor 105 measures the contamination level of the washing water and provides information on the contamination level measured thus to the controller (not shown).

In the meantime, the controller performs a washing course shown in FIG. 5 so that the contamination level sensor 105 can make an accurate measurement of the contamination level of the washing water in the preliminary washing course or the washing course.

That is, the controller performs, not the washing course for washing the dishes in succession to the water supply course for supplying the washing water, but has a pausing step for stopping the washing course temporarily in the middle of the washing course. Then, after the contamination level sensor 105 measures the contamination level of the washing water in the pausing step, courses of the dish washer are performed, such as the rinsing step and so on through a re-washing step.

In more detail, when the steps of draining-water supplying-washing are progressed in the preliminary washing or the washing course, after the pausing step in which the washing course is stopped temporarily in the middle of the washing step, the washing course is performed again.

If the controller determines that the water level of the sump 16 becomes constant by means of the water level sensor after the controller stops the washing course, after proceeding into a contamination level measuring step, the controller receives the contamination level sensed thus through the contamination level sensor 105. Then, according to the contamination level received thus, the controller controls overall courses of the dish washer, such as adjusting a time period of the washing course, or a time period of the rinsing course, or the like.

In this instance, in the middle of drop of the water level of the sump 16 due to draining of the washing water in the draining step, the water level rises in the water supply step again. Because a vortex takes places in the washing step, the water level of the sump 16 sensed at the water level sensor repeats dropping/rising.

However, since the pausing step in the middle of the washing course calms down the vortex temporarily, the water level of the sump 16 becomes constant, temporarily. If the contamination level is measured at this time point and the washing course is progressed again, the dropping/rising of the water level is repeated due to the vortex taken place thereafter.

The elimination of scattering of signals from the contamination level sensor caused by the vortex of the washing water by measuring the contamination level with the contamination level sensor 105 in a state the washing course is stopped temporarily enables to reduce an error of the contamination level of the washing water.

Moreover, as one of noise measuring methods of a dish washer, there is a method in which a total noise generated during operation of the dish washer is divided by a total operation time period. If above noise measuring method is applied, the present invention can reduce noise as an operation course of the dish water is stopped temporarily, which reduces a total noise.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling a dishwasher, the method comprising:

supplying washing water to an inside of a dishwasher;

washing dishes by spraying the washing water to the inside of the dishwasher;

temporarily pausing the washing of the dishes for a present time period; and resuming the washing of the dishes after the preset time period, wherein the pausing the washing of the dishes comprises:

determining whether a water level in a sump of the dishwasher is constant; and when the water level in the sump of the dishwasher is constant, measuring a contamination level of the washing water.

2. The method as claimed in claim 1, further comprising controlling the washing of the dishes based on the measured contamination level.

3. The method as claimed in claim 1, wherein the pausing the washing of the dishes comprises turning off the dishwasher.

4. The method as claimed in claim 1, wherein the pausing the washing of the dishes comprises pausing the washing of the dishes until the water level becomes constant when the water level is not constant.

5. The method as claimed in claim 1, wherein the measuring the contamination level of the washing water comprises measuring a turbidity of the washing water.

6. The method as claimed in claim 1, wherein the measuring the contamination level of the washing water comprises measuring the contamination level of the washing water using a contamination level sensor.

7. The method as claimed in claim 6, wherein the contamination level sensor comprises a light emitting device and a light receiving device.

8. The method as claimed in claim 6, wherein the contamination level sensor is disposed in a sampling passage of a sump of the dishwasher.

9. The method as claimed in claim 1, wherein the determining whether the water level in the sump of the dishwasher is constant comprises measuring a water level of the washing water.

10. The method as claimed in claim 2, wherein the controlling the washing of the dishes based on the measured contamination level comprises controlling overall courses of the dishwasher based on the measured contamination level.

11. The method as claimed in claim 2, wherein the controlling the washing of the dishes based on the measured contamination level comprises adjusting a time period of a washing course.

12. The method as claimed in claim 2, wherein the controlling the washing of the dishes based on the measured contamination level comprises adjusting a time period of a rinsing course.

* * * * *